United States Patent [19]

Geiger et al.

[11] 4,324,684

[45] Apr. 13, 1982

[54] STABLE COMPOSITIONS FOR USE AS CORROSION INHIBITORS

[75] Inventors: Gary E. Geiger, Philadelphia; Roger C. May, Glenside, both of Pa.

[73] Assignee: Betz Laboratories, Inc., Trevose, Pa.

[21] Appl. No.: 131,592

[22] Filed: Mar. 19, 1980

Related U.S. Application Data

[63] Continuation-in-part of Ser. No. 89,076, Oct. 29, 1979, and a continuation-in-part of Ser. No. 27,346, Apr. 5, 1979, abandoned.

[51] Int. Cl.[3] ..... C23F 11/18; C23F 11/16; C23F 11/14; C23F 11/12

[52] U.S. Cl. ..... 252/389 A; 106/14.11; 106/14.12; 106/14.13; 106/14.14; 106/14.21; 210/749; 252/8.55 E; 252/389 R; 252/181; 422/14; 422/15; 422/16; 422/17; 422/18; 422/19

[58] Field of Search ..... 252/389 R, 389 A, 8.55 E, 252/181; 422/7, 14, 15, 16, 17, 18, 19; 106/14.12, 14.14, 14.11, 14.13, 14.21; 210/749

[56] References Cited

U.S. PATENT DOCUMENTS

| | | | |
|---|---|---|---|
| 3,024,201 | 3/1962 | Bregman | 252/387 |
| 3,081,146 | 3/1963 | Boles et al. | 252/387 |
| 3,445,400 | 5/1969 | Everhart | 252/389 R |
| 3,620,777 | 11/1971 | Okabe et al. | 252/387 |
| 3,816,333 | 6/1974 | King et al. | 252/389 R |
| 3,885,914 | 5/1975 | Hollingshad | 252/401 |
| 3,965,027 | 6/1976 | Boffardi et al. | 252/390 |
| 4,018,702 | 4/1977 | Ralston et al. | 252/389 A |
| 4,029,577 | 6/1977 | Godlewski | 252/180 |
| 4,209,398 | 6/1980 | Ii et al. | 252/389 A |

*Primary Examiner*—Irwin Gluck

*Attorney, Agent, or Firm*—Alexander D. Ricci; Bruce E. Peacock

[57] ABSTRACT

A composition is disclosed comprising a stable aqueous solution of (i) water-soluble zinc compound, (ii) water-soluble chromate compound and (iii) a particular type of water-soluble polymer composed essentially of moieties derived from acrylic acid and hydroxylated lower alkyl acrylates. The composition could additionally comprise (iiii) orthophosphate.

20 Claims, 7 Drawing Figures

STABLE COMPOSITIONS FOR USE AS CORROSION INHIBITORS

TECHNICAL FIELD

This application is a Continuation-In-Part of Ser. Nos. 27,346, filed Apr. 5, 1979; now abandoned and 89,076, filed Oct. 29, 1979; and the parent applications are incorporated herein by reference.

The present invention is related to zinc-containing corrosion inhibitor treatment compositions. The ability of zinc to inhibit the corrosion of ferrous metals is, indeed, well known. Accordingly, soluble zinc salts are vital ingredients of many corrosion treatment programs. For example, U.S. Pat. No. 4,089,796 to Harris et al discloses a corrosion inhibiting composition comprising zinc and hydrolyzed polymaleic anhydride or soluble salt thereof and benzotriazole. Other exemplary patents disclosing such zinc containing treatments are U.S. Pat. No. 3,432,428 to Wirth et al and U.S. Pat. No. 4,120,655 to Crambes et al.

An art-recognized major problem encountered with zinc-containing treatments, particularly in cooling water, is the uncontrolled precipitation of zinc salts; because, to be effective, the zinc must reach the surfaces to be protected in a soluble form. For example, the use of orthophosphate in combination with zinc as a cooling water treatment is well known as evidenced by U.S. Pat. No. 2,900,222 to Kahler et al wherein phosphate, chromate and zinc are used in combination. The orthophosphate can be provided as an actual addition, or as a reversion product from any one of complex inorganic phosphate, organic phosphate or organic phosphonate. When orthophosphate and zinc are both present in the water, zinc phosphate precipitation becomes a concern. Whether or not orthophosphate is present, the zinc could precipitate in other forms, for example, as zinc hydroxide or zinc silicate. The solubility of the various salts, that is, the retention of the respective salt constituents in ionic form, depends on such factors as water temperature and pH and ion concentrations. Wirth et al states that although water temperatures can vary from 32° to 200° F., lower temperatures of 32° to 80° F. are preferred because "zinc tends to remain in solution better in cooler waters." This patent further states that alkaline waters, particularly above about pH 7.5, are relatively undesirable because "the dissolved zinc tends to deposit out or drop out much more rapidly in alkaline water." Similarly, Crambes et al points out that zinc salts are unstable in neutral or alkaline water and will precipitate with phosphates. Thus, if any of these conditions are present, the aqueous medium becomes prone to zinc precipitation. Because of the formation of this zinc scale, many of the surfaces in contact with the aqueous medium will foul and the amount of effective (soluble) corrosion inhibitor present in the aqueous medium can be significantly reduced.

Although the present invention is considered to have general applicability to any aqueous system where zinc precipitation is a problem, it is particularly useful in cooling water systems. Accordingly, the invention will hereinafter be described as it relates to cooling water systems.

DESCRIPTION OF THE INVENTION

There has existed for a long time the need for a zinc-containing corrosion inhibitor treatment which overcomes the above-noted problems, and the present invention is considered to fulfill that need.

According to the present invention, a corrosion inhibitor treatment for metal surfaces exposed to an aqueous medium comprises (i) water-soluble zinc compound (ii) water-soluble chromate compound and (iii) a particular type of water-soluble polymer composed essentially of moieties derived from acrylic acid or derivatives thereof and hydroxylated lower alkyl acrylate moieties (HAA). The treatment could additionally comprise (iii) orthophosphate. It was discovered that, although the polymer demonstrated no significant activity alone as a corrosion inhibitor, when it was combined with a zinc-containing treatment the various ionic constituents of the treatment were unexpectedly retained in their soluble form and a corresponding increase in corrosion inhibiting activity was obsesved.

DRAWINGS

THE POLYMER

Figure 1:
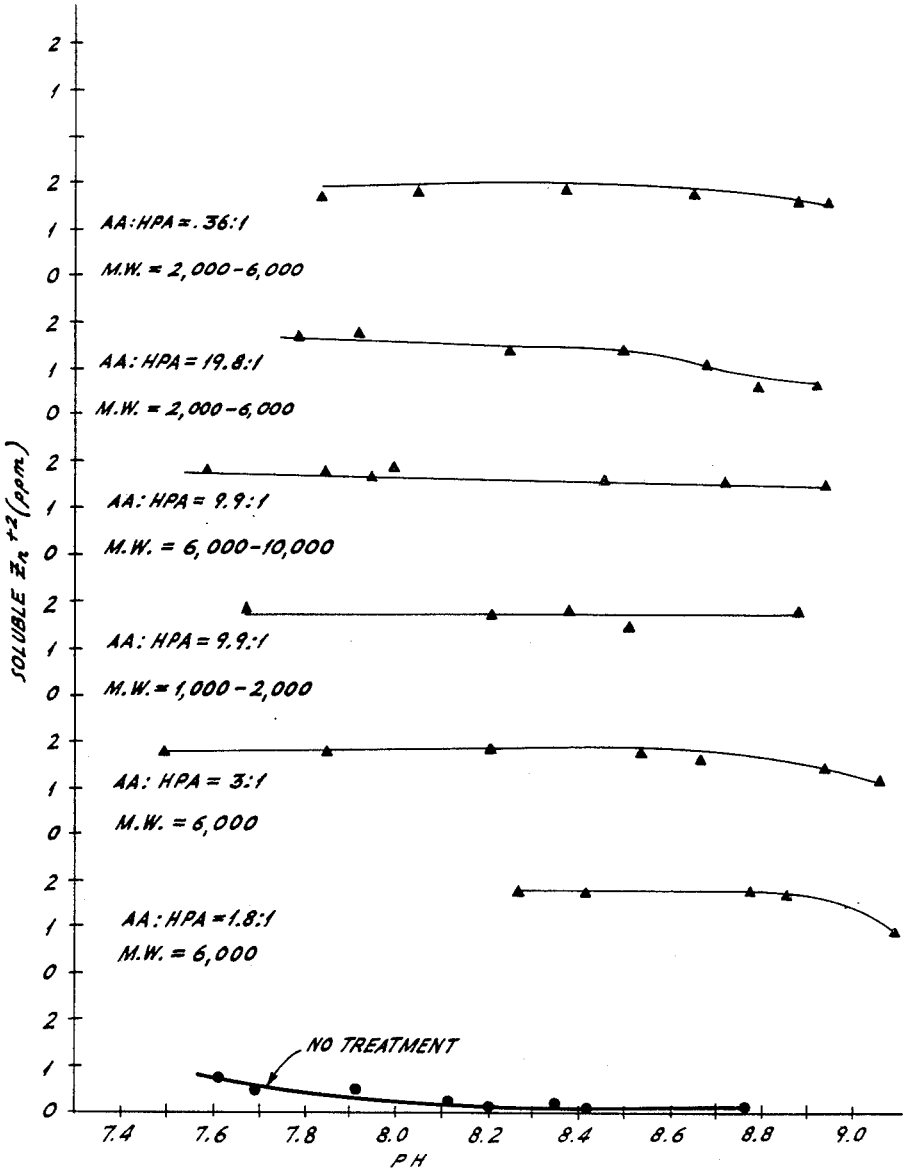
FIG. 1 is a graphic representation comparing Table I (Example I) with Table 7 (Example 4)

The polymers according to the present invention are those effective for the purpose which contain essentially moieties derived from an acrylic acid compound (AA), i.e.,

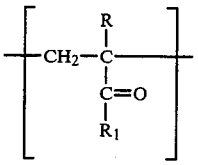

(I)

where R is hydrogen or a lower alkyl of from 1 to 3 carbon atoms and $R_1$=OH, $NH_2$ or OM, where M is a water-soluble cation, e.g., $NH_4$, alkali metal (K, Na), etc; and moieties of a hydroxylated lower alkyl ($C_2$–$C_6$) acrylate (HAA) as represented, for example, by the formula:

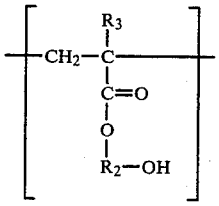

(II)

where $R_3$ is H or lower alkyl of from 1 to 3 carbon atoms, and $R_2$ is a lower alkyl having from about 2 to 6 carbon atoms.

In terms of mole ratios, the polymers are considered, most broadly, to have a mole ratio of AA:HAA of from about 1:4 to 36:1. This mole ratio is preferably about 1:1 to 11:1, and most preferably about 1:1 to 5:1. The only criteria that is considered to be of importance with respect to mole ratios is that it is desirable to have a copolymer which is water-soluble. As the proportion of hydroxylated alkyl acrylate moieties increases, the solubility of the copolymer decreases. It is noted that, from an efficacy point of view, the polymers having a mole ratio of AA:HAA of 1:1 to 5:1 were considered the best.

The polymers could have a molecular weight of from about 1,000 to about 50,000 with from about 2,000 to about 6,000 being preferred.

The polymers utilized in accordance with the invention can be prepared by vinyl addition polymerization or by treatment of an acrylic acid or salt polymer. More specifically, acrylic acid or derivatives thereof or their water soluble salts, e.g., sodium, potassium, ammonium, etc. can be copolymerized with the hydroxy alkyl acrylate under standard copolymerization conditions utilizing free radical initiators such as benzoyl peroxide, azobisisobutyronitrile or redox initiators such as ferrous sulfate and ammonium persulfate. The molecular weights of the resulting copolymer can be controlled utilizing standard chain control agents such as secondary alcohols (isopropanol), mercaptans, halocarbons, etc. Copolymers falling within the scope of the invention are commerically available from, for example, National Starch Company.

The hydroxy alkyl acrylate can be prepared by the addition reaction between the acrylic acid or its derivatives or water soluble salts and the oxide of the alkyl derivative desired. For example, the preferred monomer of the present invention is the propyl derivative. Accordingly, to obtain the hydroxylated monomer, acrylic acid is reacted with propylene oxide to provide the hydroxypropyl acrylate monomer.

The polymers of the invention may also be prepared by reacting a polyacrylic acid or derivatives thereof with an appropriate amount of an alkylene oxide having from 2 to 6 carbon atoms such as ethylene oxide, propylene oxide and the like. The reaction takes place at the COOH or COM group of the moieties to provide the hydroxylated alkyl acrylate moiety.

The polymer prepared either by copolymerization of AA with hydroxy propyl acrylate (HPA) or reaction of AA with propylene oxide would be composed of units or moieties having the structural formulas:

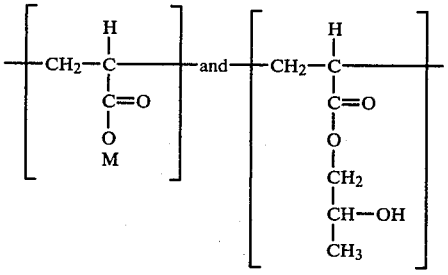

where M is as earlier defined.

THE ZINC COMPOUNDS

Illustrative water-soluble zinc compounds which are considered to be suitable for use in accordance with the present invention are zinc oxide, zinc acetate, zinc chloride, zinc formate, zinc nitrate, zinc sulphate, zinc borate, zinc chromate, zinc dichromate, etc.

THE ORTHOPHOSPHATE COMPOUNDS

As already noted above, the treatment could further comprise orthophosphate. Indeed, the use of zinc and orthophosphate together as a corrosion inhibition treatment is well known. It has also already been noted that the orthophosphate could be provided as an actual addition product, e.g., sodium orthophosphate, or as a precursor compound such as complex inorganic phosphates, organic phosphates or organic phosphonates which revert to orthophosphate in the water.

Illustrative examples of orthophosphate as an actual addition are monosodium phosphate and monopotassium phosphate. Any other water-soluble orthophosphate or phosphoric acid would also be considered to be suitable.

The complex inorganic phosphates are exemplified by sodium pyrophosphate, sodium tripolyphosphate, sodium tetraphosphate, sodium septaphosphate, sodium decaphosphate and sodium hexametaphosphate. Either the corresponding potassium or ammonium salts or the corresponding molecularly dehydrated phosphoric acids such as metaphosphoric acid or pyrophosphoric acid are considered to be suitable.

The organic phosphonates are exemplified by aminotrimethylene phosphonic acid, hydroxyethylidene diphosphonic acid and the water-soluble salts thereof.

Organic phosphates are exemplified in U.S. Pat. No. 3,510,436.

THE CHROMATE COMPOUNDS

As disclosed in U.S. Pat. No. 2,900,222 to Kahler et al, the chromate compounds would include alkali metals or any water-soluble compound that contains hexavalent chromate and provides chromate radical in water solutions. Illustrative water-soluble chromate compounds are sodium chromate dihydrate, sodium chromate anhydrous, sodium chromate tetrahydrate, sodium chromate hexahydrate, sodium chromate decahydrate, potassium dichromate, potassium chromate, ammonium dichromate and chromic acid.

The amount of each constituent added to the cooling water will, of course, be an effective amount for the purpose and will depend on such factors and the nature and severity of the corrosion problem being treated, the temperature and pH of the cooling water and the type and amount of precipitation-prone ions present in the water.

In terms of active zinc ion, as little as about 0.5 parts of zinc per million parts (ppm) of cooling water are believed to be effective in certain instances, with about 2 ppm being preferred. Based on economic considerations, the amount of zinc ion added could be as high as about 25 ppm, with about 10 ppm representing the preferred maximum.

In terms of active polymer, as little as about 0.5 ppm polymer is considered to be effective, while about 2 ppm is the preferred minimum. Based on economic considerations, the polymer could be fed in amounts as high as about 200 ppm, with about 50 ppm representing the preferred maximum.

In terms of active product added, the orthophosphate or precursor compound thereof could be fed in an amount as low as about 1 ppm, with about 2 ppm representing the preferred minimum. Based on economic considerations, the maximum amount is considered to be about 200 ppm. However, about 50 ppm is considered to be the preferred maximum.

In terms of active chromate compound added, as little as about 1 ppm is considered to be effective. The upper limit would depend on such factors as cost and toxicity and could be as high as about 150 ppm. The preferred upper limit is about 50 ppm.

Methods for feeding corrosion inhibitors to cooling water are well known in the art such that details thereof are not considered necessary. However, due to rather severe stability problems experienced when the polymer was stored at high concentrations with remaining components, a two or three-barrel treatment is recommended. It is believed that a dry powder composition is attainable and would not have such stability problems.

Based on experience, compositions according to the present invention could vary widely and would comprise on a weight basis:

(i) about 1 to about 95% of water-soluble zinc compound, (ii) about 1% to about 98% of water-soluble chromate compound, and (iii) about 1 to 95% AA/HAA polymer of the total amount of zinc compound, chromate compound and polymer.

Similarly, in those instances where orthophosphate is also present, compositions according to the present invention could comprise on a weight basis:

(i) about 1 to 95% water-soluble zinc compound (ii) about 1 to 97% AA/HAA polymer, (iii) about 1 to 97% water-soluble chromate compound, and (iiii) about 1 to 95% orthophosphate (or precursor thereof) of the total amount of zinc compound, chromate compound, polymer and orthophosphate.

The cooling water preferably will have a pH of about 6.5 to about 9.5. Since zinc precipitation problems most commonly occur at pH's above about 7.5, the most preferred pH range is from about 7.5 to about 9.5. Kahler et al U.S. Pat. No. 2,900,222, points out that the use of chromate in cooling water treatments permits the treatment of cooling water at lower ph's, e.g., pH 5.7.

EXAMPLES

ILLUSTRATION OF ZINC PRECIPITATION PROBLEM

EXAMPLE 1

As noted above, an art-recognized major problem encountered with zinc-containing treatments, particularly in cooling water, is the uncontrolled precipitation of zinc salts from the water. Even in the absence of orthophosphate in the water, the zinc can form precipitates such as zinc hydroxide.

This point is illustrated by the zinc-solubility results of several tests conducted in water containing no orthophosphate. The tests were conducted, inter alia, to determine the solubility of zinc in the test water as a function of pH.

The following aqueous test solutions were first prepared:

Solution A: 1,000 ppm $Zn^{++}$ obtained from 0.27 gram $ZnSO_4.H_2O$/100 ml $SCW_7$: 170 ppm Ca as $CaCO_3$, 110 ppm Mg as $CaCO_3$, 15 ppm $SiO_2$.

The tests were conducted using the following procedure:

1. Prepare $SCW_7$ (detailed in Example 5 below) and adjust its pH to 4 with concentrated HCl.
2. To 2,000 ml of the above solution, add the required amount of Solution A with stirring.
3. Add 100 ml of the solution from step 2 to a bottle and agitate.
4. Slowly adjust the pH to the desired value with dilute NaOH solution and record pH.
5. Place the samples in an oven at the required temperature for 24 hours, after which time, filter through a 0.2 micron millipore filter.
6. Analyze the filtrate for soluble zinc and record final pH.

The results of these tests are reported below in Tables 1 and 2 in terms of soluble zinc (ppm) remaining after 24 hours at various final pH values.

TABLE 1

ZINC PRECIPITATION AS FUNCTION OF pH

Conditions: Initial Zinc = 2 ppm as $Zn^{++}$
T = 120° F.
Time = 24 hours

| pH | soluble zinc (ppm) |
|---|---|
| 7.62 | 0.8 |
| 7.70 | 0.5 |
| 7.92 | 0.5 |
| 8.12 | 0.2 |
| 8.21 | 0.1 |
| 8.35 | 0.1 |
| 8.42 | 0.1 |
| 8.76 | 0.0 |

TABLE 2

ZINC PRECIPITATION AS FUNCTION OF pH

Conditions: Initial Zinc = 10 ppm as $Zn^{++}$
T = 120° F.
Time = 24 hours

| pH | soluble zinc (ppm) |
|---|---|
| 7.15 | 8.2 |
| 7.25 | 7.8 |
| 7.36 | 8.2 |
| 7.46 | 8.0 |
| 7.50 | 7.8 |
| 7.56 | 5.4 |
| 7.67 | 1.8 |
| 7.70 | 1.6 |
| 8.05 | 0.4 |
| 8.10 | 0.2 |
| 8.22 | 0.4 |
| 8.65 | 0.2 |
| 9.06 | 0.0 |

EXAMPLE 2

The problem of zinc precipitation in cooling water is further illustrated by the zinc-solubility results of additional tests similar to those in Example 1, but conducted in water containing both zinc ions and orthophosphate ions.

The following aqueous test solutions were first prepared:

Solution A: 1,000 ppm $PO_4^{-3}$, obtained from 0.400 gram $Na_3PO_4.12H_2O$/100 ml Solution B: 1,000 ppm $Zn^{+2}$, obtained from 0.27 gram $ZnSO_4.H_2O$/100 ml $SCW_7$: Same as Example 1

The following procedure was used:

1. Prepare $SCW_7$ and adjust its pH to 4 with HCl solution.

2. To 2,000 ml of the above solution, add the appropriate amount of Solution A, followed by the appropriate amount of Solution B with agitation.

3. Add 100 ml of the solution from step 2 to a bottle and adjust the pH to 7.5 with dilute NaOH with agitation.

4. Place the samples in an oven for 24 hours at the appropriate temperature.

5. After the 24 hour period, filter the solution through a 0.2 micron millipore filter.

6. Analyze the filtrate for $Zn^{+2}$ and $PO_4^{-3}$.

The results of these tests are reported below in Tables 3 and 4 in terms of ppm soluble zinc and ppm soluble phosphate remaining after 24 hours at various final pH values.

TABLE 3

ZINC PRECIPITATION AS FUNCTION OF pH

Conditions: Initial Zinc = 5 ppm as $Zn^{++}$
Initial o-$PO_4$ = 10 ppm
T = 120° F.
Time = 24 hours

| pH | soluble zinc (ppm) | soluble $PO_4$ (ppm) |
|---|---|---|
| 7.0 | 3 | 6 |
| 7.5 | 0.5 | 5 |
| 8.0 | 0.1 | 3.7 |
| 8.5 | 0.1 | 2.4 |
| 9.0 | 0.1 | 1.2 |

TABLE 4

ZINC PRECIPITATION AS FUNCTION OF pH

Conditions: Initial Zinc = 10 ppm as $Zn^{++}$
Initial o-$PO_4$ = 5 ppm
T = 120° F.
Time = 24 hours

| pH | soluble zinc (ppm) | soluble $PO_4$ (ppm) |
|---|---|---|
| 7.5 | 3.3 | 0.8 |
| 8.0 | 0.2 | 0.7 |

TABLE 4-continued

ZINC PRECIPITATION AS FUNCTION OF pH

Conditions: Initial Zinc = 10 ppm as $Zn^{++}$
Initial o-$PO_4$ = 5 ppm
T = 120° F.
Time = 24 hours

| pH | soluble zinc (ppm) | soluble $PO_4$ (ppm) |
|---|---|---|
| 9.0 | 0.1 | 0.1 |

EFFICACY IN RETAINING SOLUBLE ZINC-CONTAINING TREATMENTS

EXAMPLE 3

A series of tests were conducted to determine the efficacy of various materials in retaining zinc-containing corrosion inhibition treatments in a soluble form. After all, the corrosion inhibition efficacy of such treatments will, for the most part, depend on the constituents remaining soluble.

The test water contained both zinc and orthophosphate ions, and the test procedures were the same as in Example 2 but for a few different steps as follows:

1. Solution C, comprising 1,000 ppm of active treatment, was also used.

3. Add 100 ml of solution from step 2 to a bottle, add the appropriate quantity of treatment solution (1 ml=10 ppm), and adjust pH to appropriate value with dilute NaOH with agitation.

The results of the tests were calculated in terms of % increase in retention of soluble zinc ions and soluble phosphate ions vs. an untreated solution using the following equation:

$$\% \text{ Retention} = \frac{100 \times \text{Sol. } PO_4 \text{ at } T = 24 \text{ hrs} - \text{Sol. } PO_4 \text{ in control at } T = 24 \text{ hrs.}}{\text{Sol. } PO_4 \text{ in control at } T = 0 \text{ hrs} - \text{Sol. } PO_4 \text{ in control at } T = 24 \text{ hrs.},}$$

where Sol. $PO_4$=soluble $PO_4$ in ppm. Of course, a similar equation was used for zinc calculations.

The results of these tests are reported below in Tables 5 and 6. In addition to testing various AA/HPA copolymers in accordance with the present invention, various commercial polyacrylic acids (PAA) were also tested.

TABLE 5

ZINC AND PHOSPHATE RETENTION

Conditions: Initial Zinc = 10 ppm as $Zn^{++}$
Initial o-$PO_4$ = 5 ppm
T = 120° F.
Time = 24 hours

| Treatment | Mole Ratio AA:HPA | Molecular Weight | Water pH | Dosage (ppm actives) | Soluble Zinc Retained (ppm) | Soluble $PO_4$ Retained (ppm) | % Increase in Zinc Retention (vs. Control) | % Increase in $PO_4$ Retention (vs. Control) |
|---|---|---|---|---|---|---|---|---|
| None | — | — | 7.5 | — | 3.3 | 0.8 | — | — |
| PAA-Commercial | — | 5,000 | 7.5 | 5 | 2.3 | 0.8 | −15 | 0 |
| PAA-Commercial | — | 5,000 | 7.5 | 10 | 2.3 | 1.0 | −15 | 5 |
| PAA-Commercial | — | 5,000 | 7.5 | 20 | 2.4 | 1.2 | −13 | 10 |
| PAA-Commercial | — | 90,000 | 7.5 | 5 | 2.2 | 0.7 | −16 | 0 |
| PAA-Commercial | — | 90,000 | 7.5 | 10 | 2.5 | 1.0 | −12 | 5 |
| PAA-Commercial | — | 90,000 | 7.5 | 20 | 1.9 | 1.4 | −21 | 14 |
| PAA-Commercial | — | <1,000 | 7.5 | 5 | 2.9 | 0.9 | −6 | 2 |
| PAA-Commercial | — | <1,000 | 7.5 | 10 | 3.4 | 1.4 | 1 | 14 |
| PAA-Commercial | — | <1,000 | 7.5 | 20 | 3.0 | 1.2 | −4 | 10 |

TABLE 5-continued

ZINC AND PHOSPHATE RETENTION

Conditions: Initial Zinc = 10 ppm as $Zn^{++}$
Initial o-$PO_4$ = 5 ppm
T = 120° F.
Time = 24 hours

| Treatment | Mole Ratio AA:HPA | Molecular Weight | Water pH | Dosage (ppm actives) | Soluble Zinc Retained (ppm) | Soluble $PO_4$ Retained (ppm) | % Increase in Zinc Retention (vs. Control) | % Increase in $PO_4$ Retention (vs. Control) |
|---|---|---|---|---|---|---|---|---|
| AA/HPA | 1.8:1 | 6,000 | 7.5 | 2.5 | 3.7 | 1.2 | 6 | 10 |
| " | 1.8:1 | 6,000 | 7.5 | 5 | 8.6 | 4.2 | 79 | 81 |
| AA/HPA | 3:1 | 6,000 | 7.5 | 2.5 | 1.3 | 1 | −30 | 5 |
| " | 3:1 | 6,000 | 7.5 | 5 | 8.6 | 4.4 | 79 | 86 |
| AA/HPA | 9.9:1 | 1K-2K* | 7.5 | 5 | 6.8 | 4.7 | 52 | 93 |
| " | 9.9:1 | 1K-2K | 7.5 | 10 | 8.6 | 5.1 | 79 | 102 |
| AA/HPA | 9.9:1 | 6K-10K | 7.5 | 5 | 8.8 | 4.7 | 82 | 93 |
| " | 9.9:1 | 6K-10K | 7.5 | 10 | 7.2 | 4.8 | 58 | 95 |
| " | 19.8:1 | 2K-6K | 7.5 | 5 | 5.4 | 2.8 | 31 | 48 |
| " | 19.8:1 | 2K-6K | 7.5 | 10 | 5.6 | 3.2 | 34 | 57 |
| " | 36:1 | 2K-6K | 7.5 | 5 | 6.8 | 4.3 | 52 | 83 |
| " | 36:1 | 2K-6K | 7.5 | 10 | 8.8 | 4.8 | 82 | 95 |

*K = 1,000

TABLE 6

ZINC AND PHOSPHATE RETENTION

Conditions: Initial Zinc = 5 ppm as $Zn^{++}$
Initial o-$PO_4$ = 10 ppm
T = 120° F.
Time = 24 hours

| Treatment | Mole Ratio AA:HPA | Molecular Weight | Water pH | Dosage (ppm actives | Soluble Zinc Retained (ppm) | Soluble $PO_4$ Retained (ppm) | % Increase in Zinc Retention (vs. Control) | % Increase in $PO_4$ Retention (vs. Control) |
|---|---|---|---|---|---|---|---|---|
| None | — | — | 7.0 | — | 3 | 6 | — | — |
| AA/HPA | 1.8:1 | 6,000 | 7.0 | 2.5 | 4.6 | 9.2 | 80 | 80 |
| " | 1.8:1 | 6,000 | 7.0 | 5 | 4.9 | 9.5 | 95 | 87 |
| " | 3:1 | 6,000 | 7.0 | 2.5 | 4.2 | 8.9 | 60 | 72 |
| " | 3:1 | 6,000 | 7.0 | 5 | 5 | 9.4 | 100 | 85 |
| " | 9.9:1 | 1K-2K* | 7.0 | 2.5 | 4.9 | 9.3 | 95 | 82 |
| " | 9.9:1 | 1K-2K | 7.0 | 5 | 5.0 | 9.4 | 100 | 85 |
| "9.9:1 | 6K-10K | 7.0 | 2.5 | 3.2 | 6.8 | 10 | 20 | |
| "9.9:1 | 6K-10K | 7.0 | 5 | 5.0 | 9.3 | 100 | 82 | |
| " | 19.8:1 | 2K-6K | 7.0 | 2.5 | 4.3 | 8.3 | 65 | 57 |
| " | 19.8:1 | 2K-6K | 7.0 | 5 | 4.7 | 8.9 | 85 | 72 |
| "36:1 | 1K-6K | 7.0 | 2.5 | 4.3 | 8.5 | 65 | 62 | |
| AA/HPA | 36:1 | 2K-6K | 7.0 | 5 | 4.4 | 8.5 | 70 | 62 |
| None | — | — | 8.0 | — | 0.1 | 3.7 | — | — |
| AA/HPA | 1.8:1 | 6,000 | 8.0 | 2.5 | 1.8 | 5.7 | 35 | 32 |
| " | 1.8:1 | 6,000 | 8.0 | 5 | 3.8 | 8.8 | 75 | 81 |
| "3:1 | 6,000 | 8.0 | 10 | 3.8 | 8.8 | 75 | 81 | |
| " | 9.9:1 | 1K-2K | 8.0 | 10 | 3.8 | 9.1 | 75 | 86 |
| "19.8:1 | 1K-2K | 8.0 | 10 | 3.7 | 9.1 | 73 | 86 | |
| " | 36:1 | 1K-2K | 8.0 | 10 | 3.9 | 9.1 | 77 | 86 |
| None | — | — | 9.0 | — | 0.1 | 1.2 | — | — |
| AA/HPA | 1.8:1 | 6,000 | 9.0 | 30 | 4.5 | 8.4 | 90 | 82 |
| " | 1.8:1 | 6,000 | 9.0 | 20 | 4.5 | 8.4 | 90 | 82 |
| " | 3:1 | 6,000 | 9.0 | 30 | 4.6 | 8.5 | 92 | 83 |
| " | 3:1 | 6,000 | 9.0 | 20 | 4.7 | 8.7 | 94 | 85 |
| " | 9.9:1 | 1K-2K | 9.0 | 15 | 3.5 | 7.6 | 69 | 73 |
| " | 9.9:1 | 1K-2K | 9.0 | 20 | 4.4 | 7.4 | 88 | 70 |
| " | 9.9:1 | 6K-10K | 9.0 | 30 | 3.0 | 6.3 | 59 | 58 |
| " | 9.9:1 | 6K-10K | 9.0 | 20 | 4.3 | 8.4 | 86 | 82 |
| " | 19.8:1 | 2K-6K | 9.0 | 20 | 2.4 | 6.7 | 47 | 62 |
| " | 36:1 | 2K-6K | 9.0 | 30 | 4.1 | 7.9 | 82 | 76 |
| "36:1 | 2K-6K | 9.0 | 15 | 2.9 | 6.7 | 57 | 62 | |
| " | 36:1 | 2K-6K | 9.0 | 20 | 3.9 | 7.4 | 77 | 70 |

*K = 1,000

EXAMPLE 4

A further series of tests were conducted to demonstrate the efficacy of various AA/HPA polymers in retaining soluble zinc in an aqueous medium. The tests were the same as those of Example 3 except for the absence of orthophosphate from the test solutions.

The results of these tests are reported below in Tables 7–13 in terms of ppm soluble zinc retained in solution. For purposes of comparison with untreated test solution, Table 7 should be compared with the results of Table 1 and Tables 8–13 should be compared with the results of Table 2.

Visual comparisons of Table 7 with Table 1 and Tables 8–13 with Table 2 are provided in the accompanying drawing.

In FIG. 1 are presented a series of graphs which contain comparisons of Table 7 with Table 1 in terms of soluble zinc remaining in solution after 24 hours vs. pH of the test water. As can be seen from the figure, the lowermost graph represents a no treatment test wherein the zinc readily precipitates. In comparison, the higher graphs represent various tests solutions to which have been added the noted AA/HPA polymers. The polymers were all considered to be efficacious in retaining soluble zinc in solution.

Figure 2:
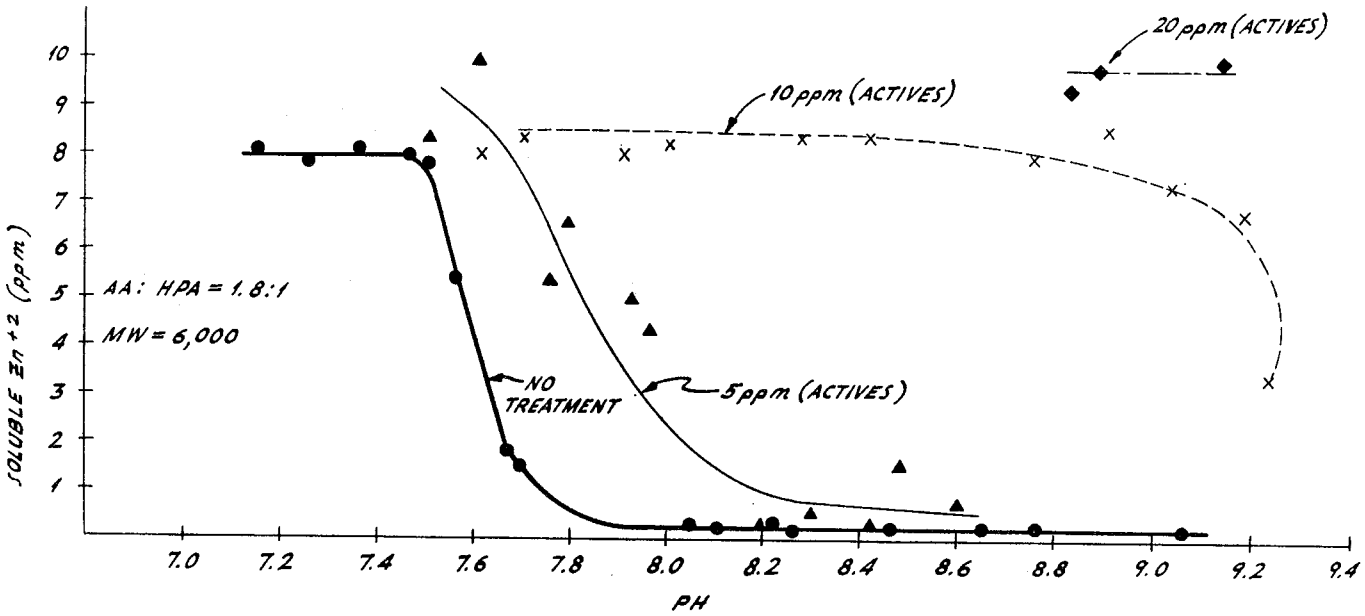
FIG. 2 is a graphic representation comparing Table 2 (Example I) with Table 8 (Example 4)
Figure 3:
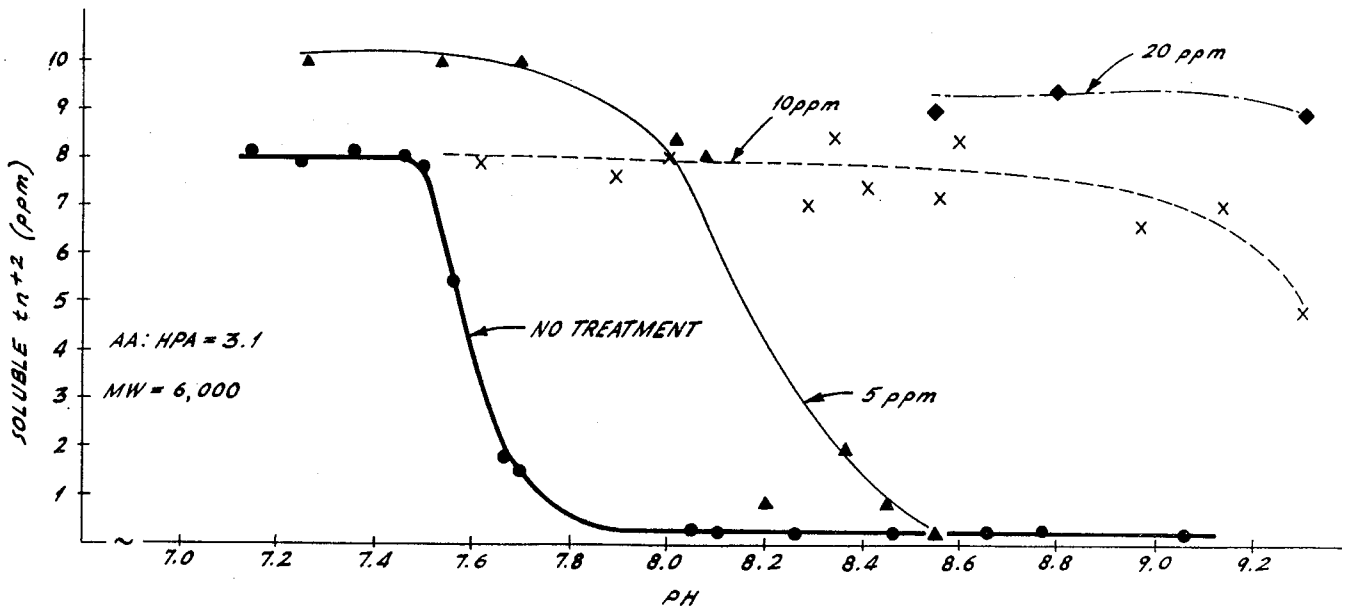
FIG. 3 is a graphic representation comparing Table 2 (Example I) with Table 9 (Example 4)
Figure 4:
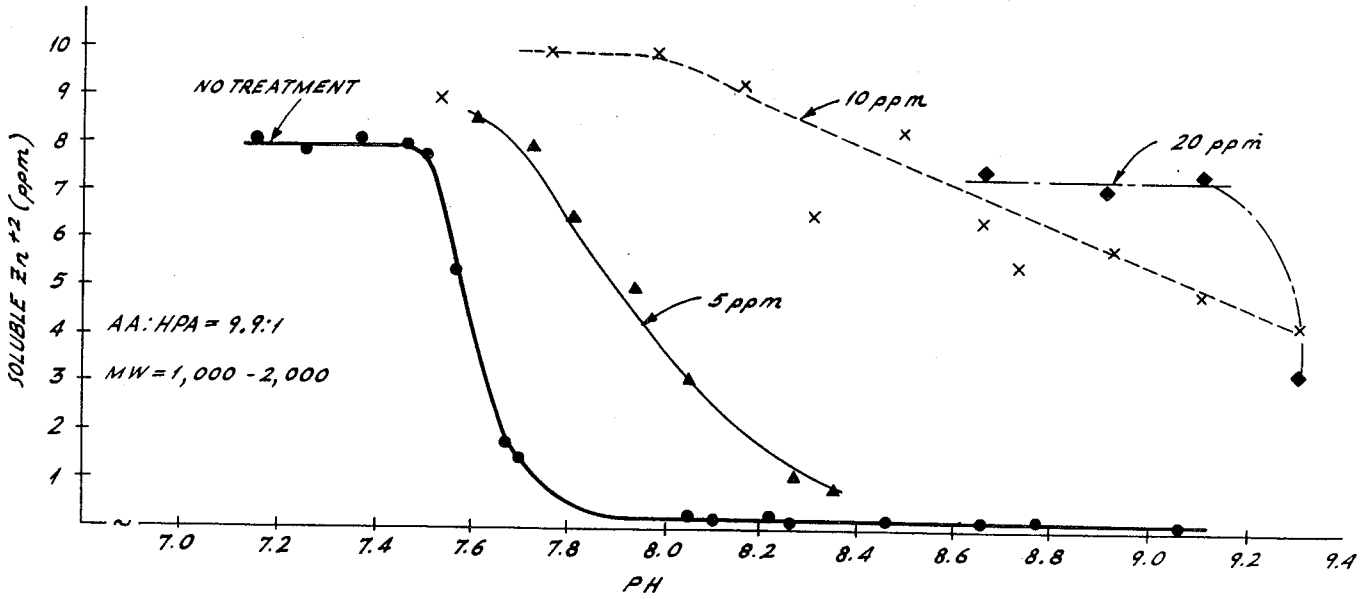
FIG. 4 is a graphic representation comparing Table 2 (Example I) with Table 10 (Example 4)
Figure 5:
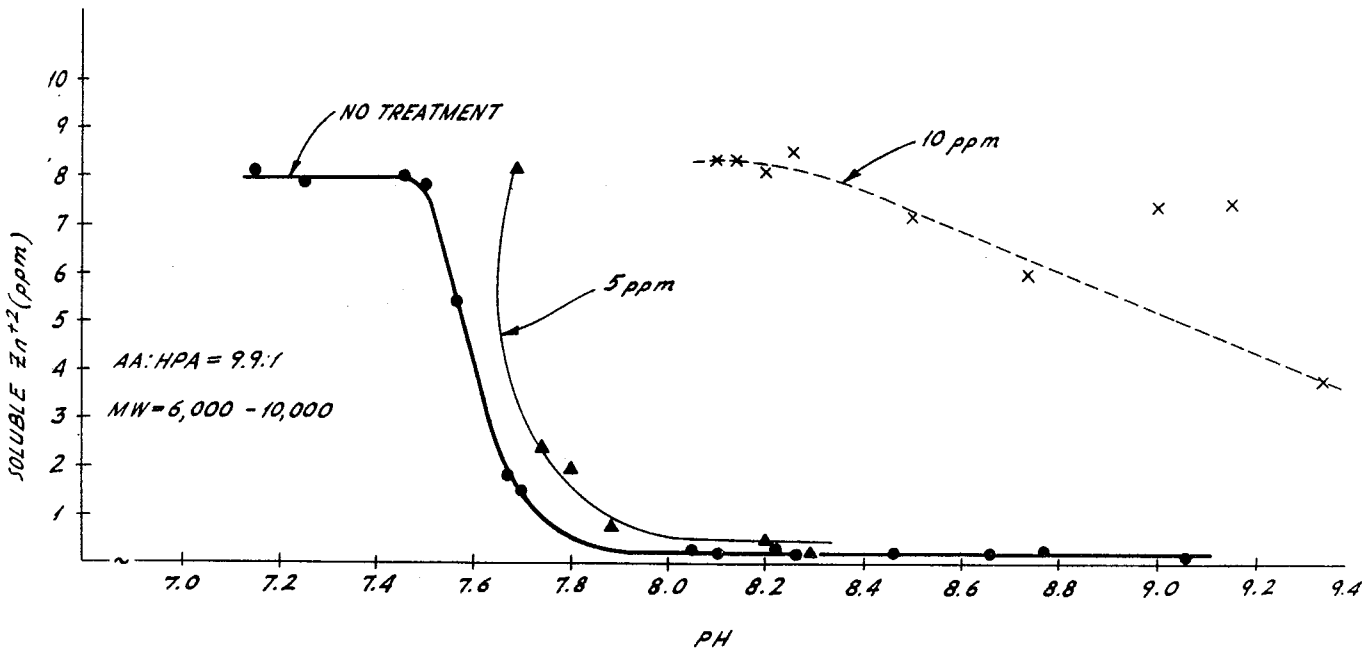
FIG. 5 is a graphic representation comparing Table 2 (Example I) with Table 11 (Example 4)
Figure 6:
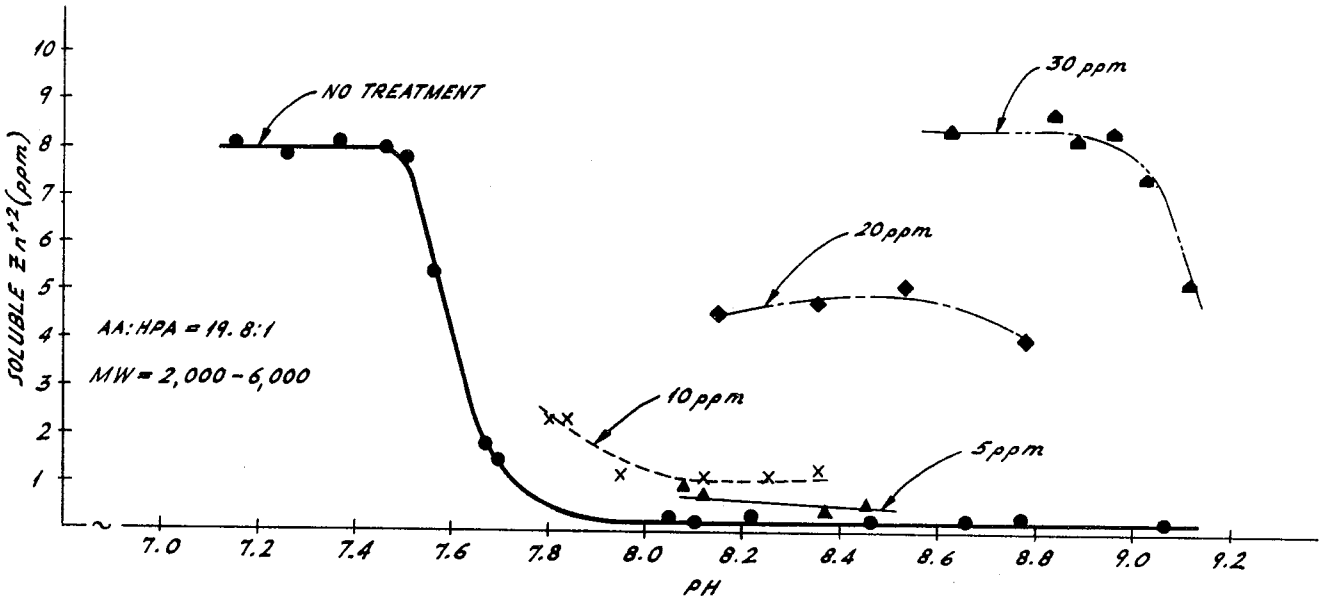
FIG. 6 is a graphic representation comparing Table 2 (Example I) with Table 12 (Example 4)
Figure 7:
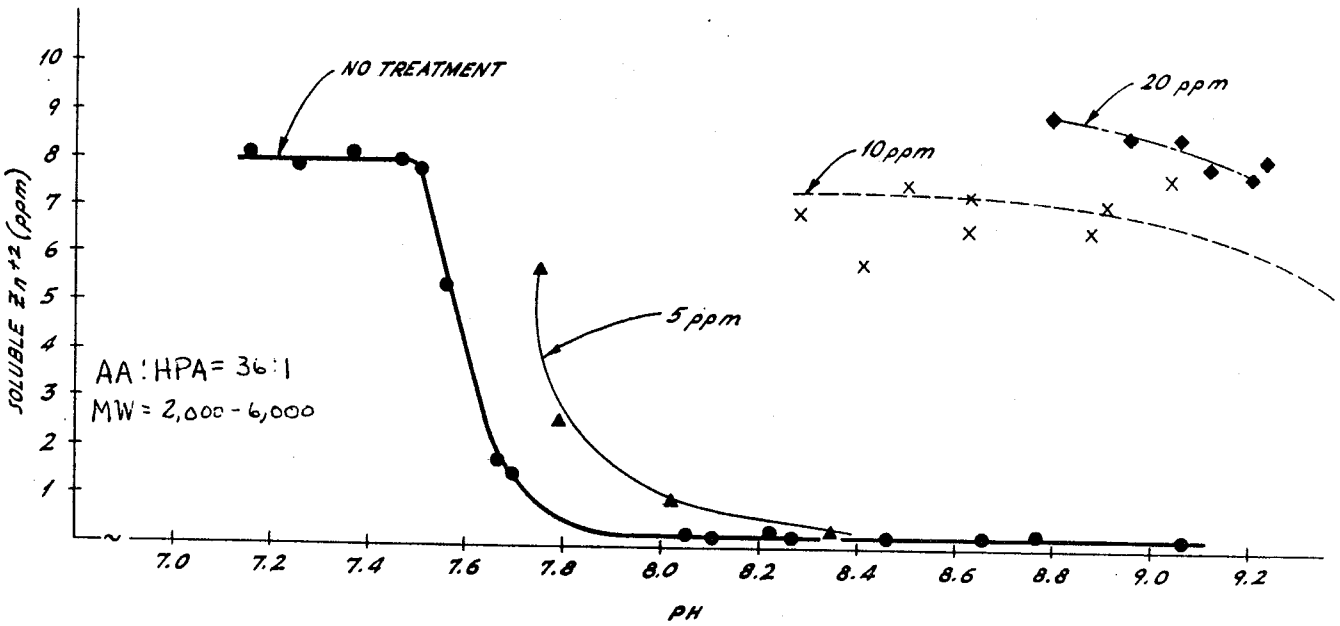
FIG. 7 is a graphic representation comparing Table 2 (Example I) with Table 13 (Example 4).

Remaining FIGS. 2–7 provide visual comparisons of respective ones of Tables 8–13 with Table 2. FIG. 2 compares Table 8, FIG. 3 compares Table 9, FIG. 4 compares Table 10, FIG. 5 compares Table 11, FIG. 6 compares Table 12, and FIG. 7 compares Table 13, all with Table 2 in terms of plots of soluble zinc remaining in solution after 24 hours vs. pH at various indicated treatment levels. The line marked "No Treatment" in each figure represents the results of Table 2.

TABLE 7

ZINC RETAINED AS COMPARED TO TABLE 1

Conditions: Initial Zinc = 2 ppm as $Zn^{++}$
T =0 120° F.
Time = 24 hours
Treatment = AA/HPA
Dosage = 5 ppm actives

| Mole Ratio AA:HPA | Molecular Weight | Water pH | Soluble Zinc Retained (ppm) |
|---|---|---|---|
| 1.8:1 | 6,000 | 8.27 | 1.8 |
| " | " | 8.42 | 1.7 |
| " | " | 8.78 | 1.8 |
| " | " | 8.86 | 1.7 |
| " | " | 9.10 | 0.9 |
| 9.9:1 | 6,000–10,000 | 7.59 | 1.7 |
| " | " | 7.85 | 1.7 |
| " | " | 7.95 | 1.7 |
| " | " | 8.00 | 1.8 |
| " | " | 8.45 | 1.6 |
| " | " | 8.72 | 1.6 |
| " | " | 8.94 | 1.5 |
| 3:1 | 6,000 | 7.50 | 1.8 |
| " | " | 7.85 | 1.8 |
| " | " | 8.21 | 1.9 |
| " | " | 8.54 | 1.8 |
| " | " | 8.67 | 1.6 |
| " | " | 8.94 | 1.5 |
| " | " | 9.06 | 1.2 |
| 9,9:1 | 1,000–2,000 | 7.68 | 1.9 |
| " | " | 8.06 | 1.8 |
| " | " | 8.21 | 1.7 |
| " | " | 8.38 | 1.8 |
| " | " | 8.51 | 1.5 |
| " | " | 8.88 | 1.7 |
| 19.8:1 | 2,000–6,000 | 7.79 | 1.7 |
| " | " | 7.92 | 1.8 |
| " | " | 8.25 | 1.4 |
| " | " | 8.50 | 1.4 |
| " | " | 8.67 | 1.1 |
| " | " | 8.92 | 0.7 |
| 36:1 | 2,000–6,000 | 7.84 | 1.7 |
| " | " | 8.05 | 1.8 |
| " | " | 8.65 | 1.7 |
| " | " | 8.88 | 1.6 |
| " | " | 8.95 | 1.6 |

TABLE 8

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 1.8:1,
Molecular Weight = 6,000

| Water pH | Treatment Dosage (ppm actives) | Soluble Zinc Retained (ppm) |
|---|---|---|
| 7.50 | 5 | 8.6 |
| 7.60 | 5 | 10.0 |
| 7.75 | 5 | 5.4 |
| 7.79 | 5 | 6.6 |
| 7.92 | 5 | 5.0 |
| 7.96 | 5 | 4.4 |
| 8.26 | 5 | 0.2 |
| 8.30 | 5 | 0.6 |
| 8.42 | 5 | 0.4 |
| 8.48 | 5 | 1.6 |
| 8.60 | 5 | 0.8 |
| 7.61 | 10 | 8.0 |
| 7.70 | 10 | 8.4 |
| 7.90 | 10 | 8.0 |
| 8.00 | 10 | 8.2 |
| 8.27 | 10 | 8.4 |
| 8.75 | 10 | 8.0 |
| 8.90 | 10 | 8.6 |
| 9.02 | 10 | 7.4 |
| 9.18 | 10 | 6.8 |
| 9.23 | 10 | 3.4 |
| 8.82 | 20 | 9.4 |
| 8.88 | 20 | 9.8 |
| 9.13 | 20 | 10.0 |

TABLE 9

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 3:1,
Molecular Weight = 6,000

| Water pH | Treatment Dosage (ppm actives) | Soluble Zinc Retained (ppm) |
|---|---|---|
| 7.27 | 5 | 10 |
| 7.54 | 5 | 10 |
| 7.77 | 5 | 10 |
| 8.02 | 5 | 8.4 |
| 8.08 | 5 | 8.0 |
| 8.20 | 5 | 0.8 |
| 8.37 | 5 | 2.0 |
| 8.45 | 5 | 0.8 |
| 8.55 | 5 | 0.0 |
| 7.62 | 10 | 7.8 |
| 7.90 | 10 | 7.6 |
| 8.00 | 10 | 8.0 |
| 8.29 | 10 | 7.0 |
| 8.34 | 10 | 8.4 |
| 8.41 | 10 | 7.4 |
| 8.56 | 10 | 7.2 |
| 8.60 | 10 | 8.4 |
| 8.97 | 10 | 6.6 |
| 9.14 | 10 | 7.0 |
| 9.30 | 10 | 4.8 |
| 8.58 | 20 | 9.0 |
| 8.80 | 20 | 9.4 |
| 9.31 | 20 | 8.8 |

TABLE 10

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 9.9:1,
Molecular Weight = 1,000–2,000

| Water pH | Treatment Dosage (ppm actives) | Soluble Zinc Retained (ppm) |
|---|---|---|
| 7.60 | 5 | 8.6 |
| 7.72 | 5 | 8.0 |
| 7.80 | 5 | 6.6 |
| 7.93 | 5 | 5.0 |
| 8.04 | 5 | 3.2 |
| 8.27 | 5 | 1.2 |
| 8.35 | 5 | 1.0 |
| 7.53 | 10 | 9.0 |
| 7.75 | 10 | 10.0 |
| 7.97 | 10 | 10.0 |
| 8.15 | 10 | 9.4 |
| 8.30 | 10 | 6.6 |
| 8.48 | 10 | 8.4 |
| 8.65 | 10 | 6.8 |
| 8.72 | 10 | 5.6 |
| 8.92 | 10 | 6.0 |
| 9.10 | 10 | 5.0 |
| 9.25 | 10 | 4.4 |
| 8.65 | 20 | 7.6 |
| 8.90 | 20 | 7.2 |
| 9.10 | 20 | 7.6 |
| 9.30 | 20 | 3.2 |

TABLE 11

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 9.9:1,
Molecular Weight = 6,000–10,000

| Water pH | Treatment Dosage (ppm actives) | Soluble Zinc Retained (ppm) |
|---|---|---|
| 7.50 | 5 | 7.6 |
| 7.68 | 5 | 8.2 |
| 7.74 | 5 | 2.4 |
| 7.80 | 5 | 2.0 |
| 7.86 | 5 | 2.8 |
| 7.88 | 5 | 0.8 |
| 8.20 | 5 | 0.6 |
| 8.27 | 5 | 0.2 |
| 8.58 | 5 | 0.2 |
| 8.10 | 10 | 8.4 |
| 8.13 | 10 | 8.4 |
| 8.20 | 10 | 8.2 |
| 8.25 | 10 | 8.6 |
| 8.50 | 10 | 7.2 |
| 8.74 | 10 | 6.0 |
| 9.01 | 10 | 7.4 |
| 9.14 | 10 | 7.6 |
| 9.32 | 10 | 3.8 |

TABLE 12

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 19.8:1,
Molecular Weight = 2,000–6,000

| Water pH | Treatment Dosage (ppm actives) | Soluble Zinc Retained (ppm) |
|---|---|---|
| 7.80 | 10 | 2.4 |
| 7.83 | 10 | 2.4 |
| 7.95 | 10 | 1.2 |
| 8.08 | 10 | 1.0 |
| 8.12 | 10 | 1.2 |

TABLE 12-continued

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 19.8:1,
Molecular Weight = 2,000–6,000

| Water pH | Treatment Dosage (ppm actives) | Soluble Zinc Retained (ppm) |
|---|---|---|
| 8.25 | 10 | 1.2 |
| 8.35 | 10 | 1.4 |
| 8.15 | 20 | 4.6 |
| 8.35 | 20 | 4.8 |
| 8.52 | 20 | 5.2 |
| 8.78 | 20 | 4.0 |
| 8.62 | 30 | 8.4 |
| 8.83 | 30 | 8.6 |
| 8.88 | 30 | 8.2 |
| 8.95 | 30 | 8.4 |
| 9.02 | 30 | 7.4 |
| 9.11 | 30 | 5.2 |

TABLE 13

ZINC RETAINED AS COMPARED TO TABLE 2

Conditions: Initial Zinc = 10 ppm as $Zn^{++}$
T = 120° F.
Time = 24 hours
Treatment =
AA/HPA, Mole Ratio AA:HPA = 36:1,
Molecular Weight = 2,000–6,000

| Water pH | Treatment Dosage (ppm actives) | Soluble Zinc Retained (ppm) |
|---|---|---|
| 7.75 | 5 | 5.8 |
| 7.79 | 5 | 2.6 |
| 8.02 | 5 | 1.0 |
| 8.34 | 5 | 0.2 |
| 8.66 | 5 | 0.0 |
| 8.27 | 10 | 7.0 |
| 8.40 | 10 | 5.8 |
| 8.50 | 10 | 7.6 |
| 8.62 | 10 | 6.6 |
| 8.87 | 10 | 6.6 |
| 8.90 | 10 | 7.2 |
| 9.03 | 10 | 7.8 |
| 9.40 | 10 | 5.2 |
| 8.79 | 20 | 9.0 |
| 8.95 | 20 | 8.6 |
| 9.05 | 20 | 8.6 |
| 9.11 | 20 | 7.0 |
| 9.21 | 20 | 7.8 |
| 9.23 | 20 | 7.2 |

EFFICACY AS CORROSION INHIBITOR

EXAMPLE 5

Having already demonstrated both the zinc precipitation problem related to zinc-containing corrosion inhibitor treatments in aqueous mediums and the resolution of this problem by combining the treatment with AA/-HAA polymer, the following test results are presented to demonstrate, from a corrosion inhibition point of view, the benefits of the combined treatments.

The tests were each conducted with two non-pretreated low carbon steel coupons which were immersed and rotated in aerated synthetic cooling water for a 3 or 4 day period. The water was adjusted to the desired pH and readjusted after one day if necessary; no further adjustments were made. Water temperature was 120° F. Rotational speed was maintained to give a water velocity of 1.3 feet per second past the coupons. The total volume of water was 17 liters. Cooling water was manufactured to give the following conditions:

| | $SCW_7$ (pH = 7) | $SCW_8$ (pH = 8) |
|---|---|---|
| ppm Ca as $CaCO_3$ | 170 | 170 |
| ppm Mg as $CaCO_3$ | 110 | 110 |
| ppm $SiO_2$ | 15 | 15 |
| ppm $Na_2CO_3$ | 0 | 100 |

Corrosion rate measurements was determined by weight loss measurement. Prior to immersion, coupons were scrubbed with a mixture of trisodium phosphate-pumice, rinsed with water, rinsed with isopropyl alcohol and then air dried. Weight measurement to the nearest milligram was made. At the end of one day, a weighed coupon was removed and cleaned. Cleaning consisted of immersion into a 50% solution of HCl for approximately 20 seconds, rinsing with tap water, scrubbing with a mixture of trisodium-pumice until clean, then rinsing with tap water and isopropyl alcohol. When dry, a second weight measurement to the nearest milligram was made. At the termination of the tests, the remaining coupon was removed, cleaned and weighed.

Corrosion rates were computed by differential weight loss according to the following equation:

$$\text{Corrosion Rate} = \frac{N^{th}\text{ Day Weight Loss} - 1^{st}\text{ Day Weight Loss}}{N-1}$$

where N=3 or 4.

The cooling water was prepared by first preparing the following stock solutions:

Solution A—212.4 g $CaCl_2.2H_2O$/l

Solution B—229.9 g $MgSO_4.7H_2O$/l

Solution C—25.5 g $NaSiO_3.9H_2O$/l

Solution D—85 g $Na_2CO_3$/l

Treatment Solutions—1.7% solutions (1.7 g/100 ml)

Then, these solutions were combined using the following order of addition:

1. To 17 l of de-ionized water add, with stirring, (a) 20 ml of Solution A, (b) 20 ml of Solution B and (c) 20 ml of Solution C.
2. Adjust pH to 6.
3. With stirring add treatment (except $Zn^{+2}$).
4. Add o-$PO_4$ Solution (if used).
5. Adjust pH to 7.0 if necessary.
6. Add $Zn^{+2}$ Solution (if used).
7.(a) for $SCW_7$ adjust pH to 7.0.

(b) For $SCW_8$ add 20 ml of Solution D and adjust pH to 8.0.

The results of these tests are reported below in Table 14 in terms of corrosion rates in mils per year (mpy).

TABLE 14

| CORROSION INHIBITION | | | | | | |
|---|---|---|---|---|---|---|
| Polymer (ppm) | AA:HPA | Molecular Weight | o-$PO_4$ (ppm) | Zinc (ppm as $Zn^{++}$) | pH | Corrosion Rate (mpy) |
| 5 | 3:1 | 6,000 | — | — | 7 | 155 |
| 50 | 3:1 | 6,000 | — | — | 7 | 35 |
| — | — | — | 10 | 2 | 7 | 2.8 |
| 5 | 3:1 | 6,000 | 10 | 2 | 7 | 2.5 |
| — | — | — | 5 | 2 | 7 | 8 |
| 5 | 3:1 | 6,000 | 5 | 2 | 7 | 3 |
| 5 | 1.8:1 | 6,000 | 10 | 2 | 7 | 2.1 |
| None | — | — | — | — | 8 | 82 |
| 30 | 3:1 | 6,000 | — | — | 8 | 86 |
| — | — | — | — | 10 | 8 | 84 |
| 5 | 3.1 | 6,000 | — | 5 | 8 | 13.6 |
| 15 | 3.1 | 6,000 | — | 10 | 8 | 13.4 |
| — | — | — | 5 | 2 | 8 | 21.5 |

TABLE 14-continued

| CORROSION INHIBITION | | | | | | |
|---|---|---|---|---|---|---|
| Polymer (ppm) | AA:HPA | Molecular Weight | o-$PO_4$ (ppm) | Zinc (ppm as $Zn^{++}$) | pH | Corrosion Rate (mpy) |
| 5 | 3:1 | 6,000 | 5 | 2 | 8 | 1.5 |
| 5 | 1.8:1 | 6,000 | 5 | 2 | 8 | 0 |
| — | — | — | 3 | 2 | 8 | 76 |
| 5 | 3:1 | 6,000 | 3 | 2 | 8 | 1.6 |
| 5 | 1.8:1 | 6,000 | 3 | 2 | 8 | 8.6 |

While the comparative test results were not so pronounced at pH=7, the comparative results at pH=8 were considered to be rather dramatic. Even though the AA/HPA polymer alone demonstrated little, if any, efficacy as a corrosion inhibitor, when combined with the zinc-containing treatments, the combined treatments demonstrated significantly enhanced results as corrosion inhibitors. For example, at pH=8, the corrosion inhibition efficacy of 30 ppm active polymer alone (86 mpy) and 10 ppm $Zn^{+2}$ alone (84 mpy) appeared to be non-existent as compared to the untreated system (82 mpy); however, when only 5 ppm polymer were combined with only 5 ppm $Zn^{+2}$, the corrosion rate decreased to 13.6 mpy.

EXAMPLE 6

Additional tests were conducted to demonstrate the efficacy of AA/HPA copolymer in combination with a cooling water treatment containing zinc, orthophosphate and water-soluble chromate. This cooling water treatment is taught in U.S. Pat. No. 2,900,222 to Kahler et al. The copolymer was also tested in combination with zinc and water-soluble chromate, the latter two components individually being well-known cooling water treatment compounds.

The test procedures were generally the same as those described in Example 5; spinner tests were used, and coupon weight loss measurements provided the basis for calculating corrosion rates. Test conditions were as follows:

spinner volume=17 liters ppm calcium as $CaCO_3$=170 ppm magnesium as $CaCO_3$=110 ppm chloride=121 ppm sulfate=106 ppm silica=15

M-alkalinity=80 ppm bulk water temperature=120° F.

pH=8.0

The results of these tests are reported below in Table 15 in terms of corrosion rates in mils per year (mpy). The copolymer had a mole ratio of AA:HPA of 3:1 and a molecular weight of 6,000. The chromate used was sodium dichromate, $Na_2Cr_2O_7.2H_2O$.

TABLE 15

| CORROSION INHIBITION | | | | |
|---|---|---|---|---|
| Copolymer (ppm) | o-$PO_4$ (ppm) | Zinc (ppm) | Chromate (ppm) | Corrosion Rate[1] |
| 16 | — | — | — | 25[2] |
| — | 7.3 | 7.3 | 1.4 | 0.44 |
| 5 | 5 | 5 | 1 | 0.33 |
| 17 | — | — | — | 33 |
| — | 7.1 | 7.1 | 2.8 | 0.56 |
| 5 | 5 | 5 | 2 | 0 |
| 22 | — | — | — | 44 |
| — | 9.2 | 9.2 | 3.6 | 0.66 |
| 10 | 5 | 5 | 2 | 0 |
| 20 | — | — | — | 39 |

TABLE 15-continued

| Copolymer (ppm) | CORROSION INHIBITION o-$PO_4$ (ppm) | Zinc (ppm) | Chromate (ppm) | Corrosion Rate[1] |
|---|---|---|---|---|
| — | 6.67 | 6.67 | 6.67 | 0.33[2] |
| 5 | 5 | 5 | 5 | 0 |
| — | 8.33 | 8.33 | 8.33 | 0.44 |
| 5 | — | 5 | 5 | 0 |
| 5 | — | 5 | 2 | 0.25 |

[1]Unless indicated otherwise, these values each represent an average for 3 runs.
[2]Average for 2 runs.

As can be seen from the results of Table 15, the AA/HPA in combination with zinc/chromate and zinc/chromate/orthophosphate proved to be efficacious for corrosion inhibition.

Illustrative examples of aqueous compositions are presented in Tables 16 and 17 in terms of relative proportions (in weight percent) of the various constituents. In these compositions, the water-soluble zinc compound was $ZnSO_4.H_2O$, the orthophosphate was $Na_3PO_4.12H_2O$ and the water-soluble chromate compound was $Na_2Cr_2O_7.2H_2O$. Since calculations were rounded-off to two places, not all compositions added up to 100%. Stability is defined in terms of soluble constituents in solution after 24 hours at 120° F. In Table 17, the copolymer had a mole ratio of AA:HPA of 3:1 and a molecular weight of 6,000, and the pH was 8.0. The compositions reported in Table 17 are those used in the tests reported in Example 6.

TABLE 16

| ILLUSTRATIVE EXAMPLES OF COMPOSITIONS | | | | | |
|---|---|---|---|---|---|
| Mole Ratio AA:HPA | Molecular Weight | Water pH | Weight % Polymer | Weight % Zinc | Weight % $PO_4$ |
| 1.8:1 | 6,000 | 7.5 | 34 | 50 | 16 |
| 1.8:1 | 6,000 | 7.5 | 28 | 48 | 24 |
| 3:1 | 6,000 | 7.5 | 52 | 27 | 21 |
| 3:1 | 6,000 | 7.5 | 28 | 48 | 24 |
| 9.9:1 | 1K-2K | 7.5 | 30 | 41 | 28 |
| 9.9:1 | 1K-2K | 7.5 | 42 | 36 | 22 |
| 9.9:1 | 6K-10K | 7.5 | 27 | 48 | 25 |
| 9.9:1 | 6K-10K | 7.5 | 45 | 33 | 22 |
| 19.8:1 | 2K-6K | 7.5 | 38 | 41 | 21 |
| 19.8:1 | 2K-6K | 7.5 | 53 | 30 | 17 |
| 36:1 | 2K-6K | 7.5 | 31 | 42 | 27 |
| 36:1 | 2K-6K | 7.5 | 42 | 37 | 20 |
| 1.8:1 | 6,000 | 7.0 | 15 | 28 | 56 |
| 3:1 | 6,000 | 7.0 | 16 | 27 | 57 |
| 3:1 | 6,000 | 7.0 | 26 | 26 | 48 |
| 9.9:1 | 1K-2K | 7.0 | 15 | 29 | 56 |
| 19.8:1 | 2K-6K | 7.0 | 27 | 25 | 48 |
| 36:1 | 2K-6K | 7.0 | 28 | 25 | 47 |
| 1.8:1 | 6,000 | 8.0 | 25 | 18 | 57 |
| 3:1 | 6,000 | 8.0 | 44 | 17 | 39 |
| 19.8:1 | 1K-2K | 8.0 | 44 | 16 | 40 |
| 1.8:1 | 6,000 | 9.0 | 70 | 10 | 20 |
| 1.8:1 | 6,000 | 9.0 | 61 | 14 | 26 |
| 3:1 | 6,000 | 9.0 | 70 | 11 | 20 |
| 9.9:1 | 1K-2K | 9.0 | 57 | 13 | 29 |
| 9.9:1 | 1K-2K | 9.0 | 63 | 14 | 23 |
| 9.9:1 | 6K-10K | 9.0 | 76 | 8 | 16 |
| 19.8:1 | 2K-6K | 9.0 | 69 | 8 | 23 |
| 36:1 | 2K-6K | 9.0 | 71 | 10 | 19 |
| 1.8:1 | 6,000 | 8.27 | 74 | 26 | — |
| 1.8:1 | 6,000 | 8.42 | 75 | 25 | — |
| 1.8:1 | 6,000 | 9.10 | 85 | 15 | — |
| 9.9:1 | 6K-10K | 7.59 | 75 | 25 | — |
| 9.9:1 | 6K-10K | 8.45 | 76 | 24 | — |
| 9.9:1 | 6K-10K | 8.94 | 77 | 23 | — |
| 3:1 | 6,000 | 7.50 | 74 | 26 | — |
| 3:1 | 6,000 | 8.54 | 74 | 26 | — |
| 3:1 | 6,000 | 9.06 | 81 | 19 | — |
| 9.9:1 | 1K-2K | 7.68 | 72 | 28 | — |
| 9.9:1 | 1K-2K | 8.88 | 75 | 25 | — |

TABLE 16-continued

| ILLUSTRATIVE EXAMPLES OF COMPOSITIONS | | | | | |
|---|---|---|---|---|---|
| Mole Ratio AA:HPA | Molecular Weight | Water pH | Weight % Polymer | Weight % Zinc | Weight % $PO_4$ |
| 19.8:1 | 2K-6K | 8.92 | 88 | 12 | — |
| 36:1 | 2K-6K | 7.84 | 75 | 25 | — |
| 36:1 | 2K-6K | 8.65 | 75 | 25 | — |
| 36:1 | 2K-6K | 8.95 | 76 | 24 | — |
| 1.8:1 | 6,000 | 7.50 | 37 | 63 | — |
| 1.8:1 | 6,000 | 7.60 | 33 | 67 | — |
| 1.8:1 | 6,000 | 7.75 | 48 | 52 | — |
| 1.8:1 | 6,000 | 7.92 | 50 | 50 | — |
| 1.8:1 | 6,000 | 7.96 | 53 | 47 | — |
| 1.8:1 | 6,000 | 8.26 | 96 | 4 | — |
| 1.8:1 | 6,000 | 8.30 | 89 | 11 | — |
| 1.8:1 | 6,000 | 8.60 | 86 | 14 | — |
| 1.8:1 | 6,000 | 9.23 | 75 | 25 | — |
| 1.8:1 | 6,000 | 8.88 | 67 | 33 | — |
| 1.8:1 | 6,000 | 8.12 | 89 | 11 | — |
| 1.8:1 | 6,000 | 8.62 | 78 | 22 | — |

TABLE 17

| ILLUSTRATIVE EXAMPLES OF COMPOSITIONS | | | |
|---|---|---|---|
| Weight % Polymer | Weight % Zinc | Weight % Chromate | Weight % o-$PO_4$ |
| 31 | 31 | 6 | 31 |
| 29 | 29 | 12 | 29 |
| 46 | 23 | 9 | 23 |
| 25 | 25 | 25 | 25 |
| 40 | 20 | 20 | 20 |
| 33 | 33 | 33 | 0 |
| 42 | 42 | 17 | 0 |

Having thus described the invention what is claimed is:

1. A composition comprising in combination:
(i) water-soluble zinc compound,
(ii) water-soluble chromate compound, and
(iii) water-soluble polymer comprising moieties derived from acrylic acid or water-soluble salt thereof and moieties of hydroxylated lower alkyl acrylate, wherein the moieties of said polymer have the following formulas:

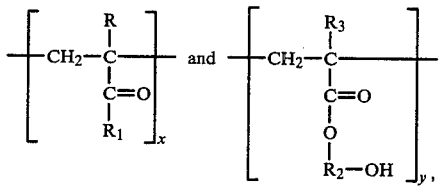

where R is hydrogen or a lower alkyl of from 1 to 3 carbon atoms; $R_1$ is OH, $NH_2$ or OM where M is a water-soluble cation; $R_2$ is a lower alkyl of about 2 to 6 carbon atoms, $R_3$ is H or lower alkyl of from 1 to 3 carbon atoms and the mole ratio of x:y is 1:4 to 36:1, said polymer being capable of retaining a corrosion inhibiting amount of said zinc compound in soluble form in said aqueous medium.

2. The composition of claim 1, wherein on a weight basis said zinc compound comprises about 1 to 95%, said chromate compound comprises about 1 to 98%, and said polymer comprises about 1 to 95% of the total amount of water-soluble zinc compound, water-soluble chromate compound and water-soluble polymer.

3. The composition of claim 2, wherein said polymer has a molecular weight of about 1,000 to 50,000.

4. The composition of claim 3, wherein the pH of said aqueous solution is about 6.5 to 9.5.

5. The composition of claim 1, comprising a stable aqueous solution of said components (i)–(iii).

6. The composition of claim 5, wherein said polymer has a molecular weight of about 1,000 to 50,000.

7. The composition of claim 6, wherein the pH of said aqueous solution is about 6.5 to 9.5.

8. The composition of claim 1, 3 or 6 wherein the mole ratio of x:y is about 1:1 to 11:1.

9. The composition of claim 8, wherein said polymer has a molecular weight of about 2,000 to 6,000.

10. The composition of claim 9, wherein the pH of said aqueous solution is about 6.5 to 9.5.

11. The composition of claim 7, wherein said polymer is acrylic acid/hydroxypropylacrylate.

12. The composition of claim 11, wherein the mole ratio of x:y is about 1:1 to 5:1.

13. A composition comprising in combination:

(i) water-soluble zinc compound, (ii) water-soluble chromate compound, (iii) water-soluble orthophosphate or precursor thereof, and (iiii) water-soluble polymer comprising moieties derived from acrylic acid or water-soluble salt thereof and moieties of hydroxylated lower alkyl acrylate, wherein the moieties of said polymer have the following formulas:

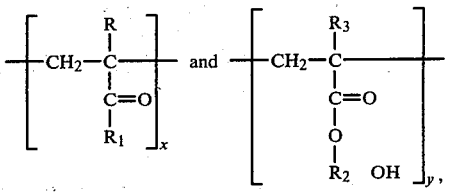

where R is hydrogen or a lower alkyl of from 1 to 3 carbon atoms; $R_1$ is OH, $NH_2$ or OM where M is a water-soluble cation; $R_2$ is a lower alkyl of about 2 to 6 carbon atoms, $R_3$ is H or lower alkyl of from 1 to 3 carbon atoms and the mole ratio of x:y is 1:4 to 36:1, said polymer being capable of retaining a corrosion inhibiting amount of said zinc compound in soluble form in said aqueous medium.

14. The composition of claim 13, wherein on a weight basis, said zinc compound comprises about 1 to 95%, said orthophosphate comprises about 1 to 95%, said chromate compound comprises about 1 to 97%, and said polymer comprises about 1 to 97% of the total amount of water-soluble zinc compound, water-soluble orthophosphate or precursor, water-soluble chromate and water-soluble polymer.

15. The composition of claim 14, wherein said polymer has a molecular weight of about 1,000 to 50,000.

16. The composition of claim 15, wherein the pH of said aqueous solution is about 6.5 to 9.5.

17. The composition of claim 13, 15 or 16, comprising a stable aqueous solution of said components (i)–(iiii).

18. The composition of claim 17, wherein the mole ratio of x:y is about 1:1 to 11:1.

19. The composition of claim 18, wherein said polymer has a molecular weight of about 2,000 to 6,000.

20. The composition of claim 19, wherein said polymer is acrylic acid/hydroxypropylacrylate.

* * * * *